US006006666A

United States Patent [19]

Göttling

[11] Patent Number: 6,006,666

[45] **Date of Patent: *Dec. 28, 1999**

[54] METHOD AND APPARATUS FOR ERASING THE INK-CARRYING LAYER FROM THE SURFACE OF AN IMAGE-CONTAINING PRINTING FORM

[75] Inventor: Josef Göttling, Friedberg, Germany

[73] Assignee: Man Roland Druckmaschinen AG, Offenbach am Main, Germany

[ * ] Notice: Under 35 U.S.C. 154(b), the term of this patent shall be extended for 758 days.

[21] Appl. No.: 08/521,013

[22] Filed: Aug. 30, 1995

Related U.S. Application Data

[63] Continuation-in-part of application No. 08/275,811, Jul. 15, 1994, abandoned, which is a continuation of application No. 08/064,963, May 18, 1993, abandoned.

[30] Foreign Application Priority Data

May 20, 1992 [DE] Germany ..... 42 16 636

[51] Int. Cl.[6] ..... B41F 35/00

[52] U.S. Cl. ..... 101/425

[58] Field of Search ..... 101/423, 424, 101/425; 134/4, 5, 17, 30, 38

[56] References Cited

U.S. PATENT DOCUMENTS

| | | | |
|---|---|---|---|
| 2,356,771 | 8/1944 | McKinley . | |
| 3,355,324 | 11/1967 | Catzen | 101/423 |
| 3,800,702 | 4/1974 | Roberts | 101/425 |
| 3,801,369 | 4/1974 | Gregory et al. | 101/425 |
| 4,686,902 | 8/1987 | Allain et al. | 101/424 |
| 5,107,764 | 4/1992 | Gasparrini | 101/423 |

FOREIGN PATENT DOCUMENTS

| | | | |
|---|---|---|---|
| 0 523 584 A1 | 1/1993 | European Pat. Off. . | |
| 1013667 | 8/1957 | Germany . | |
| 2539025 | 3/1976 | Germany . | |
| 2603971 | 9/1976 | Germany . | |
| 3248178 | 7/1984 | Germany . | |
| 3713801 | 11/1988 | Germany . | |
| 3917844 | 10/1990 | Germany . | |
| 4123959 | 2/1993 | Germany . | |
| 0163861 | 7/1986 | Japan | 101/425 |
| 0004948 | 1/1988 | Japan | 101/425 |

OTHER PUBLICATIONS

IBM Technical Disc. Bulletin vol. 25, No. 8 Jan. 1983 "High pressure cleaning system for disks" K. Chew et al.

*Primary Examiner*—Ren Yan

*Attorney, Agent, or Firm*—Cohen, Pontani, Lieberman & Pavane

[57] ABSTRACT

A method and an apparatus for repeatedly erasing the ink-carrying layer of a printing form which is covered by an image and is suitable for offset printing. An erasing device directs a jet of pressurized medium at an angle of less than 90° against the surface of the printing form on which the image is applied. A relative movement is carried out between the printing form and the erasing device, so that the image elements of the ink-carrying layer are removed over the entire surface of the printing form. The pressurized medium is preferably water.

8 Claims, 1 Drawing Sheet

METHOD AND APPARATUS FOR ERASING THE INK-CARRYING LAYER FROM THE SURFACE OF AN IMAGE-CONTAINING PRINTING FORM

This is a continuation, continuation-in-part of application Ser. No. 08/275,811, filed Jul. 15, 1994, now abandoned, which is a continuation of 08/064,963 filed May 18, 1993 now also abandoned.

BACKGROUND OF THE INVENTION

1. Field of the Invention

The present invention relates to a method and an apparatus for repeatedly erasing an ink-carrying layer from the surface of an image-containing printing form which is usable for offset printing.

2. Description of the Related Art

As proposed, for example, in German Patent 39 17 844 owned by the instant assignee, a direct image application, in this case by means of a thermo-transfer method , is conventionally carried out by applying on a hydrophilic aluminum plate organic substances which influence in accordance with the image the manner in which the ink is carried. The substances are applied on portions of the surface of the printing form by means of an image point transfer unit in accordance with a digital image information. For this purpose, a thermo-transfer foil is used which has on its side facing the printing form a thermo-sensitive coating. By applying energy, the oleophilic image elements are dissolved or removed from the coating, transferred to the printing form and are anchored as an ink-carrying layer on the surface of the printing form.

However, the ink-carrying layer can also be anchored on the surface of the printing form as an image by means of the ink-jet process or by means of an electrostatic process utilizing a toner.

In addition to the hydrophilic aluminum plate, it is also possible to use as the printing form a printing cylinder with a cylinder jacket of ceramic material, or a solid ceramic or glass cylinder can be used.

As is readily apparent in the use of printing cylinders, it should be possible to repeatedly use the printing forms to which the image is applied directly. For this purpose, the printing forms to which the image has been applied in the above-described manner must be regenerated, i.e., the material forming the printed areas must be removed or erased and it may additionally be necessary to subject the surface of the printing form to a treatment to render it hydrophilic.

Previously used methods of erasing the subject on the printing form, such as softening, vaporizing, decomposing, burning of the image elements, frequently have the disadvantage that the method is carried out in several stages which means that the method is cumbersome and the surface of the printing form is subjected to a high mechanical or abrasive load.

In addition, erasing of the surface of the printing form is usually carried out after the printing process. Thus, initially the inking device and the damping device are turned off and the remaining residues of the printing ink on the form cylinder are removed by means of cleaning devices which are conventionally used in machines of this type.

German application P 41 23 959.8 discloses a method of regenerating printing forms to which an image is applied directly and which are suitable for offset printing, in which the image on the surface of printing forms is erased and the surface is rendered hydrophilic without damaging or attacking the surface and which is comparatively simple.

The method described in the German application makes it possible to reactively erase organic substance particles or components on the surface of the printing form which had been applied thereon by means of ink-jet methods, electrostatic methods as well as thermo-transfer methods.

SUMMARY OF THE INVENTION

Therefore, it is a primary object of the present invention to develop a method of erasing the ink-carrying layer (layers, inks, toners) from a printing form on which an image has been applied in the above-described manner, wherein it is possible to repeatedly apply an image on the water-carrying layer of the printing form, wherein the method is comparatively even simpler than known methods, and wherein the method can be carried out with a simple apparatus.

In accordance with the present invention, an erasing device directs a jet of pressurized medium against the surface of the printing form to remove image elements from the printing form and simultaneously render the printing form hydrophilic. The erasing device includes at least one nozzle which guides the jet in such a way that it impinges obliquely at an angle $\alpha$ which is smaller than 90° on the surface of the printing form. The printing form and the erasing device are movable relative to each other.

Since the invention makes it possible to release or separate the oleophilic image elements from the surface of the printing form by means of a jet of pressurized medium, substantial quantities of acids or solvents can be saved, thereby significantly contributing to the protection of the environment.

The mechanical or abrasive load acting on the printing form is relatively small. Tests have shown that a printing form erased in this manner can be reused at least 10 to 20 times. A removal of image elements from the printing form by means of a steam jet is also possible, however, requires a longer application period. Furthermore, tests have shown that, for example, an aluminum plate erased in this manner can be reused immediately. In other words, a treatment to render the plate hydrophilic is not necessary. Another advantage of the present invention is the fact that the erasing device can be used within the printing machine as well as outside of the printing machine.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DESCRIPTION OF THE PREFERRED EMBODIMENTS

Figure 1:
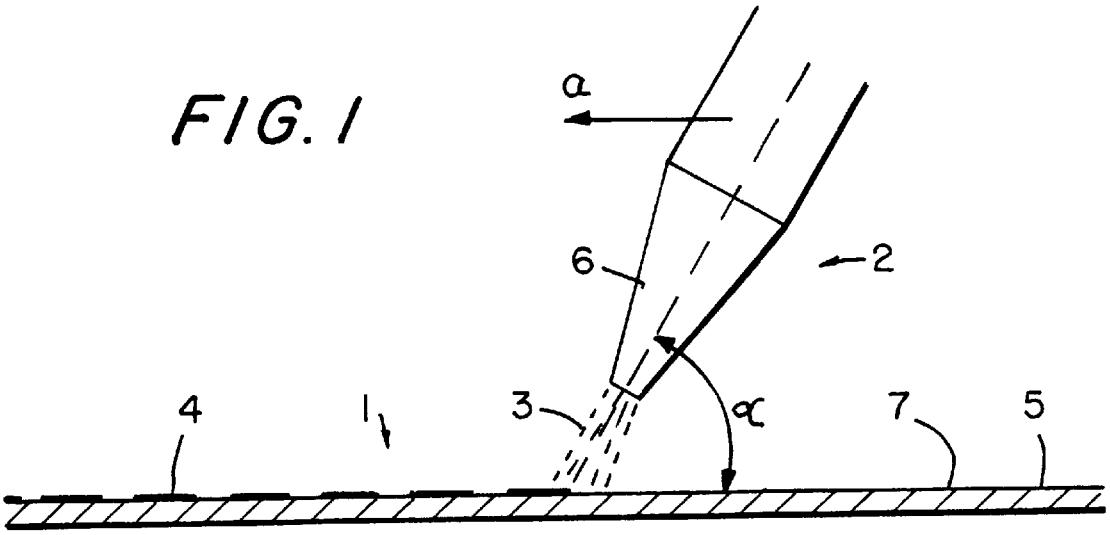
FIG. 1 is a schematic view showing the erasing device for erasing a printing form outside of the printing machine.

FIG. 1 of the drawing shows a printing form 1 which is plane and, therefore, is located outside of a printing machine. Reference numeral 2 denotes an erasing device which guides a water jet 3. Very small image elements 4 which correspond in their size to an image point have been separated from the coating of a thermo-transfer foil and placed on the printing form 1. The image elements 4 have solidified on the surface of the printing form 1 and, because of the oleophilic property thereof, form on the surface of the printing form 1 the ink-carrying layer on the water-carrying layer 5 of the printing form 1. In order to be able to show the image elements 4, they are illustrated in the drawing on a substantially enlarged scale.

The erasing device 2 essentially includes a nozzle 6 which is connectable to the output of a commercially available high-pressure cleaning unit, as it is known, for example, from motor vehicle washing plants. The nozzle 6 points at an angle toward the surface of the printing form 1, so that the water jet 3 impinges on the surface of the printing form 1 at an angle $\alpha$ which is smaller than 90°. The nozzle 6 can be guided either manually or automatically line-by-line and in the direction of arrow a over the printing form 1, so that the water jet 3 can separate or release the image elements 4 from the water-carrying layer 5 of the printing form 1 and simultaneously render the printing form 1 hydrophilic. An already erased portion 7 is shown behind the erasing device 2 as seen in the direction of movement designated by arrow a.

Figure 2:
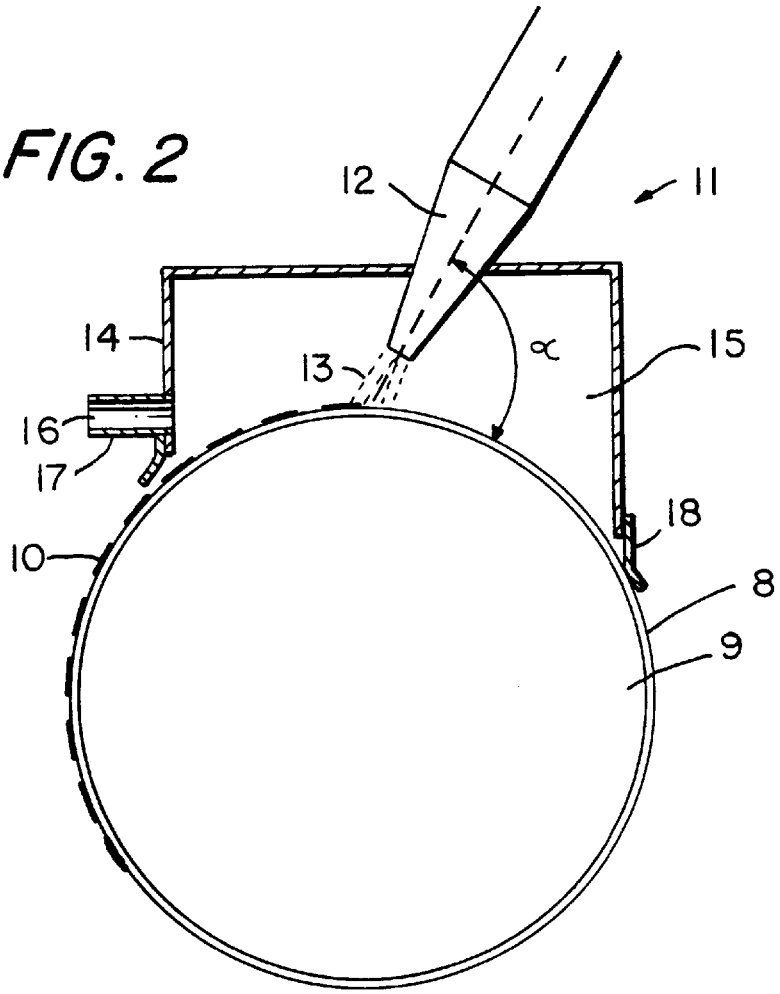
FIG. 2 is a schematic view showing the erasing device for erasing a printing form within the printing machine.

A second example of the use of the invention is illustrated in FIG. 2. A printing form 8 is mounted on a plate cylinder 9. Accordingly, the method of repeatedly erasing the ink-carrying layer, represented by the image elements 10, is carried out within the printing machine.

As illustrated in FIG. 2, an erasing device 11 is fixedly mounted in the printing machine over a portion of the surface of the printing form 8 and extends over the width of the printing form 8. The erasing device 11 includes a plurality of nozzles 12 which are arranged in a line extending over the width of the printing form 8. As in the case of the first example described above, the nozzles are connected to the output of a commercially available high-pressure cleaning unit. The nozzles 12 direct several jets 13 of a pressurized medium, preferably water, against the surface of the printing form 8 inclined at an angle which is smaller than 90°. During the application of the jets 13, the printing form 8 is rotated and moved underneath the erasing device 11.

The arrangement and number of nozzles 12 is selected in such a way that the entire surface of the printing form 8 can be erased. The nozzles 12 of the erasing device 11 are mounted in a cover 14 in order to protect the surrounding area. The cover 14 is open toward the printing form 8 and defines a work space 15. Another opening 16 of the cover 14 serves to discharge the water introduced into the work space 15 and the coating separated by the jets. The opening 16 can usually be connected through a flange 17 to a pump, not shown.

In accordance with an advantageous feature, the cover 14 is provided with suitable sealing elements 18 to be placed on the printing form 8. The work space 15 is advantageously sealed relative to the printing form 8 in the manner known from sealing technology of rotary transmissions, for example, in the form of sliding packings or by means of the use of ferro-fluids. During the offset printing procedure, the erasing device including the sealing elements thereof are raised from the printing form. The erasing device can be arranged at all freely accessible locations at the circumference of the printing form cylinder. Thus, an overhead arrangement is also possible.

The medium applied by the jets, preferably water, is maintained in the erasing device 2 or 11 at least at a pressure that is greater than 5 bar. Tests have shown that a quick and complete separation of the ink-carrying layer is achieved preferably at a pressure of 100 bar and a water temperature of about 90° C. If the pressure is lower, it is advantageous to heat the printing form 1 or 8. In the printing machine, the heating can be carried out in known manner by means of one or more radiation sources which are mounted in the interior of the plate cylinder 9 and which are directed toward the inner wall surface of the printing form 8. The radiation sources are capable of raising the temperature on the surface of the printing form 8 almost to the melting point of the substance forming the image elements. In this case, the plate cylinder preferably is made of glass or glass ceramic.

Of course, a modification of the jet of pressurized medium directed against the printing form is possible by adding to the water abrasive additives, such as, sand or similar substances, or chemical additives which have wax-dissolving properties, so that the removal efficiency of the jets is increased.

The erasing device 2, 11, whether mounted outside or inside the printing machine, can be raised from the printing form surface to such an extent that there is always sufficient space, for example, for a CPT imaging unit in the printing machine.

In addition, the method according to the present invention and the apparatus for carrying out the method can also be used for erasing a gravure cylinder filled by a thermo-transfer process, i.e., the surface of the cylinder which is completely provided with cuplets which are filled with an organic substance in the areas which do not contain the image.

It should be understood that the preferred embodiment and examples described are for illustrative purposes only and are not to be construed as limiting the scope of the present invention which is properly delineated only in the appended claims.

I claim:

1. A method of repeatedly erasing an ink-carrying layer from a surface of an aluminum printing form to which an image is applied and which is suitable for offset printing, the image having image elements, the method comprising directing by means of an erasing device a jet of pressurized solvent-free water at a pressure of greater than 5 bar, in a work space defined by a cover, against the surface of the printing form inclined at an angle of less than 90° relative to the surface of the printing from, carrying out a relative movement between the printing form and the erasing device, so that the image elements are removed from the entire surface of the printing form and the printing form is simultaneously rendered hydrophilic by the pressurized jet, and removing the water containing the removed image elements from the cover via an outlet opening in the cover.

2. The method according to claim 1, wherein the ink-carrying layer has been applied by means of a thermo-transfer procedure, the method further comprising applying heat to the surface of the printing form.

3. The method according to claim 2, wherein the image elements are formed by a substance having a melting point, the method further comprising heating the printing form such that the temperature on the surface of the printing form almost reaches the melting point of the substance forming the image elements.

4. The method according to claim 1, comprising maintaining the pressurized water jet at a pressure of about 100 bar and maintaining the water at a temperature of approximately 90° C.

5. The method according to claim 1, comprising guiding the erasing device directing the jet of pressurized medium against the surface of the printing form line-by-line transversely and longitudinally over the entire surface of the printing form.

6. The method according to claim 1, wherein the printing form has a width and the erasing device extends over the entire width of the printing form, the method further comprising guiding the jet of pressurized medium over the width of the printing form and simultaneously moving the printing form in a rotating motion underneath the erasing device.

7. An apparatus for repeatedly erasing an ink-carrying layer from an impervious surface of a printing form having a width, to which an image is applied and which is suitable for offset printing, the apparatus comprising an erasing device for directing a jet of pressurized solvent-free water at a pressure of greater than 5 bar against the surface of the printing form, the erasing device comprising at least one nozzle for guiding the jet toward the surface of the printing form inclined at an angle smaller than 90° relative to the surface of the printing form, means for carrying out a relative motion between the printing form and the erasing device so that the image is removed by the water jet and the printing form is simultaneously rendered hydrophilic, and a cover, the at least one nozzle being mounted in the cover, the cover being open toward the printing form, defining a work space and having another opening for discharging the water introduced into the work space and the layer removed from the surface of the printing form.

8. The apparatus according to claim 7, wherein the erasing device is fixedly mounted in a printing machine, the printing form having a width, such that the jet is directed toward a portion of the surface of the printing form over the entire width thereof during a rotary movement of the printing form underneath the erasing device.

* * * * *